US005322048A

United States Patent [19]

Baker

[11] Patent Number: 5,322,048

[45] Date of Patent: Jun. 21, 1994

[54] ARCHERY BOW ARROW REST APPARATUS

[76] Inventor: Christopher T. Baker, 6905 Saxby Ct., Raleigh, N.C. 27613

[21] Appl. No.: 27,652

[22] Filed: Mar. 8, 1993

[51] Int. Cl.[5] ..... F41B 5/00

[52] U.S. Cl. ..... 124/44.5

[58] Field of Search ..... 124/44.5, 41.1, 88

[56] References Cited

U.S. PATENT DOCUMENTS 5,065,731 11/1991 Smith ..... 124/44.5

OTHER PUBLICATIONS

Archery World, Apr. 1988, Martin Advertisement, pp. 2 and 3.

Bowhunter's Warehouse Catalog, Jun. 1988, p. 37.

*Primary Examiner*—Randolph A. Reese

*Assistant Examiner*—Anthony Knight

*Attorney, Agent, or Firm*—E. Michael Combs

[57] ABSTRACT

An arrow rest is arranged for permitting overdrawing of an archery arrow employing a guide block having spaced first and second plates, including confronting bearing inserts to effect support and guidance of the arrow for flight.

2 Claims, 4 Drawing Sheets

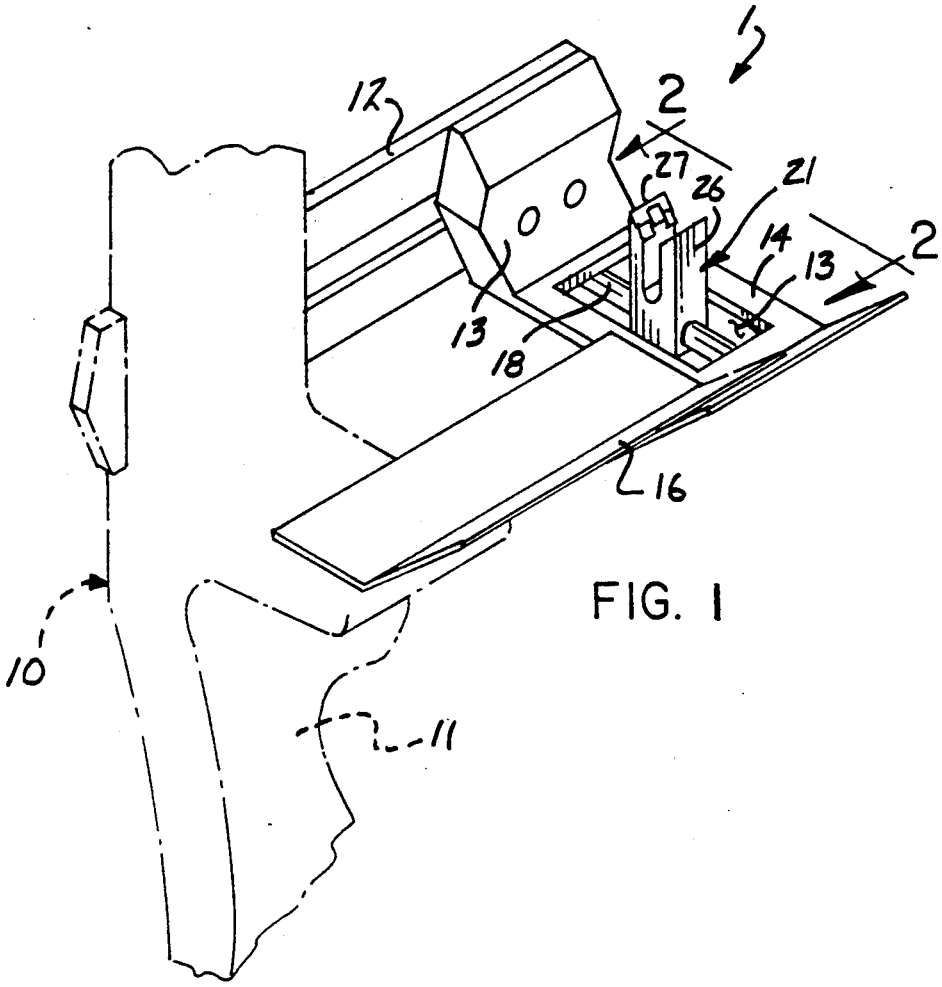
FIG. 1
FIG. 2
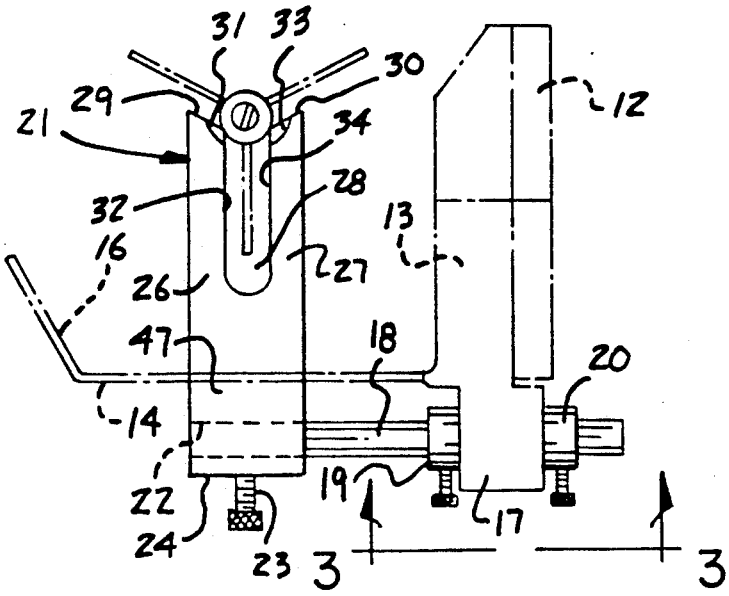

ARCHERY BOW ARROW REST APPARATUS

BACKGROUND OF THE INVENTION

1. Field of the Invention

The field of invention relates to arrow support structure, and more particularly pertains to a new and improved archery bow arrow rest apparatus arranged to effect rigidity for repetitive use in an archery environment.

2. Description of the Prior Art

The overdrawing of an archery arrow is frequently employed to provide for enhanced pressure directed to the arrow or to employ sure arrows that have a characteristic of enhanced speed relative to conventional length arrows. To this end, an archery rest structure is mounted rearwardly of the archery handle between the archery handle and an associated bow string to provide for guidance of the arrow in flight. Prior art archery rest structure is indicated in U.S. Pat. No. 4,838,237.

The instant invention attempts to overcome deficiencies of the prior art by providing for an archery support structure of enhanced rigidity minimizing deflection and for greater repetitive use and in this respect, the present invention substantially fulfills this need.

SUMMARY OF THE INVENTION

In view of the foregoing disadvantages inherent in the known types of arrow rest structure now present in the prior art, the present invention provides an archery bow arrow rest apparatus wherein the same employs a pivoting guide block having facing guide plates to accommodate an arrow at an upper distal end of the guide plates. As such, the general purpose of the present invention, which will be described subsequently in greater detail, is to provide a new and improved archery bow arrow rest apparatus which has all the advantages of the prior art arrow rest structure and none of the disadvantages.

To attain this, the present invention provides an arrow rest arranged for permitting overdrawing of an archery arrow employing a guide block having spaced first and second plates, including confronting bearing inserts to effect support and guidance of the arrow for flight.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved archery bow arrow rest apparatus which has all the advantages of the prior art arrow rest structure and none of the disadvantages.

It is another object of the present invention to provide a new and improved archery bow arrow rest apparatus which may be easily and efficiently manufactured and marketed.

It is a further object of the present invention to provide a new and improved archery bow arrow rest apparatus which is of a durable and reliable construction.

An even further object of the present invention is to provide a new and improved archery bow arrow rest apparatus which is susceptible of a low cost of manufacture with regard to both materials and labor, and which accordingly is then susceptible of low prices of sale to the consuming public, thereby making such archery bow arrow rest apparatus economically available to the buying public.

Still yet another object of the present invention is to provide a new and improved archery bow arrow rest apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the invention.

FIG. 2 is an orthographic view, taken along the lines 2—2 of FIG. 1 in the direction indicated by the arrows.

DESCRIPTION OF THE PREFERRED EMBODIMENT

Figure 3:
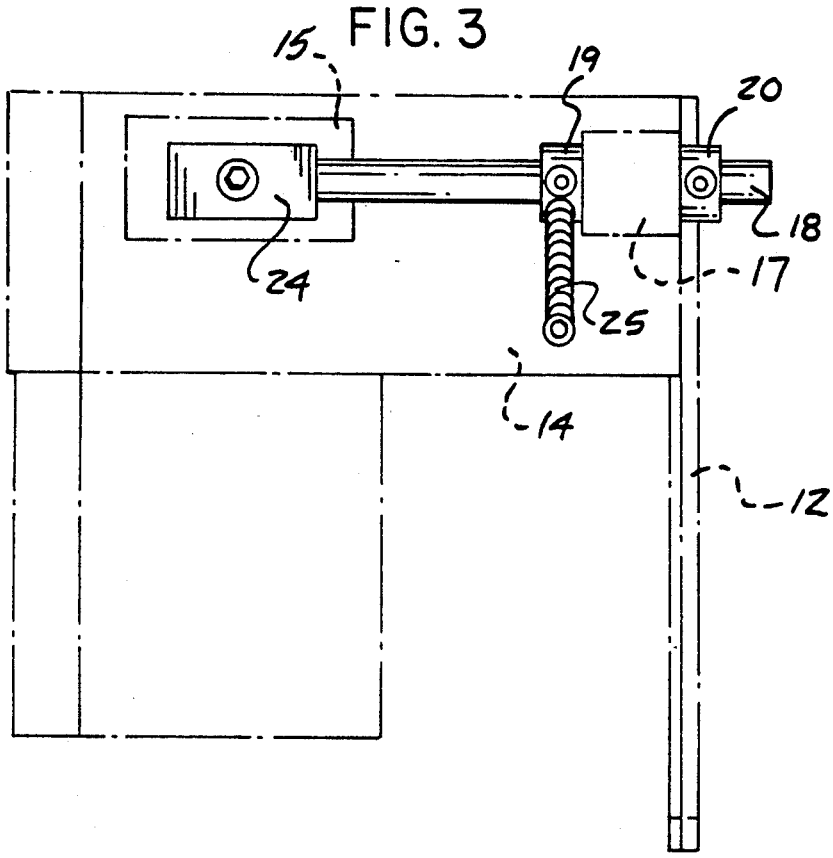
FIG. 3 is an orthographic view, taken along the lines 3—3 of FIG. 2 in the direction indicated by the arrows.

With reference now to the drawings, and in particular to FIGS. 1 to 9 thereof, a new and improved archery bow arrow rest apparatus embodying the principles and concepts of the present invention and generally designated by the reference numeral 1 will be described.

More specifically, the archery bow arrow rest apparatus 1 of the instant invention essentially comprises cooperation with an archery bow 10 having an archery bow handle 11, wherein a mounting plate 12 is mounted to the archery bow in adjacency to the handle extending orthogonally relative to the archery bow between the archery bow and associated bow string (not shown). A support head 13 is fixedly mounted to the mounting plate 12, with the support head having a support plate 14 integral with and extending orthogonally relative to the support head and in an orthogonal relationship relative to the mounting plate 12, with the support plate 14 having a support plate opening 15. An arrow shield 16 extends from the support plate 14 for shielding relative to an arrow, as indicated in FIG. 2, mounted upon the apparatus. A support head boss 17 extends below the support plate 14 that is integral with the support head 13, with the support head boss 17 rotatably mounting a rotary shaft 18 orthogonally therethrough, with the rotary shaft 18 oriented below and parallel the support plate 14 extending below the opening 15. Respective first and second collars 19 and 20 mounted to the rotary shaft 18 are positioned on opposed sides of the support head boss 17 to position the rotary shaft 18 relative to the support head boss 17. A guide block 21 is provided receiving the rotary shaft 18 therethrough, with the guide block including a shaft receiving bore 22 to receive the rotary shaft 18, with a shaft fastener 23 directed through the guide block bottom wall 24 to engage the rotary shaft 18 within the shaft receiving bore 22 to permit selective adjustment and positioning of the guide block 21 relative to the support plate 14 and the associated plate opening 15.

Figure 4:
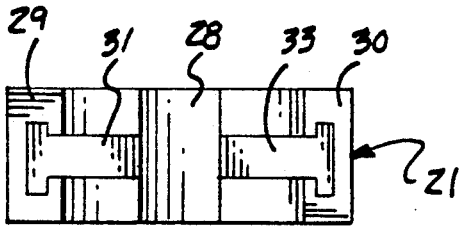
FIG. 4 is an orthographic top view of the guide block structure.
Figure 5:
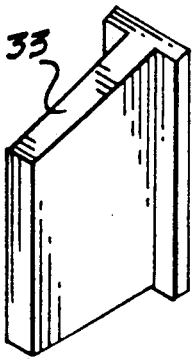
FIG. 5 is an isometric illustration of an insert structure utilized by the invention.

Reference to FIG. 3 indicates a return spring 25 having its first end mounted to the first collar 19 and its second end mounted to the support plate 14 to bias and maintain the guide block 21 in a substantially orthogonal orientation relative to the support plate 14 permitting its deflection in a rotary manner upon guidance of an arrow relative to the guide block 21. The guide block 21 includes a guide block base 47, wherein the guide block base 47 includes respective first and second plates 26 and 27 arranged in a parallel coextensive relationship relative to one another defining a gap 28 therebetween. The first plate 26 includes a first plate canted top wall 29, with the second plate including a second plate canted top wall 30 defining an obtuse included angle between the first and second plate canted top walls 29 and 30 respectively to accommodate an arrow thereon. Respective first and second polymeric bore TEFLON inserts 31 and 33 are mounted to respective first and second plates 26 and 27. The first insert 31 is mounted and received within the first insert through the canted top wall 29 at an intersection of the canted top wall and the first plate interior wall 32. A second plate interior wall 34 arranged in a facing mirror image relationship relative to the first plate interior wall is such that the second plate interior wall 34 and the second plate canted top wall 30 form an intersection to receive the second insert 33. The insert construction, as indicated in FIG. 5 of a generally T-shaped configuration, received within the a T-shaped slot relative to the first and second plates, as indicated in FIG. 4 for example.

Figure 6:
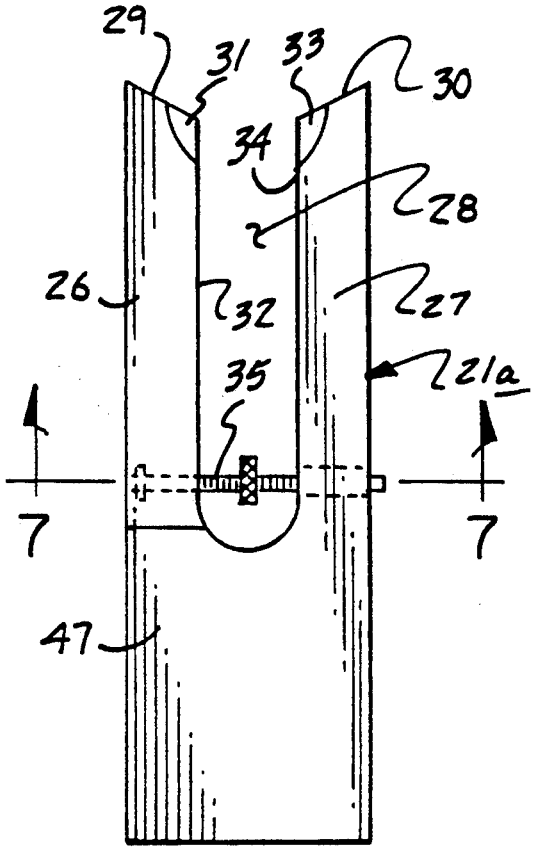
FIG. 6 is an orthographic view of a modified guide block structure.
Figure 7:
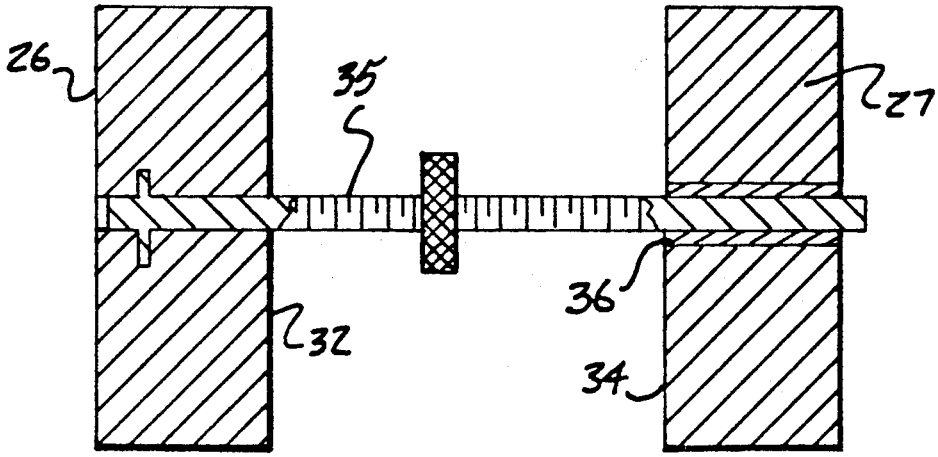
FIG. 7 is an enlarged orthographic view, taken along the lines 7—7 of FIG. 6 in the direction indicated by the arrows.

The FIGS. 6 and 7 indicates the use of a modified guide block 21*a*, having the first plate 26 including a T-shaped slot 46 (see FIG. 8) slidable along a T-shaped projection 46*a* mounted to the guide block base 47. In this manner, variation of the gap 28 is available in support of arrows of varying diameters. A threaded adjuster rod 35 extends orthogonally through the first and second plates 26 and 27, wherein the adjuster rod 35 has its first end rotatably and fixedly oriented within the first plate and threadedly directed through a threaded adjuster rod 35, whereupon rotation of the adjuster rod permits displacement of the first plate relative to the second plate in an adjustable relationship.

Figure 8:
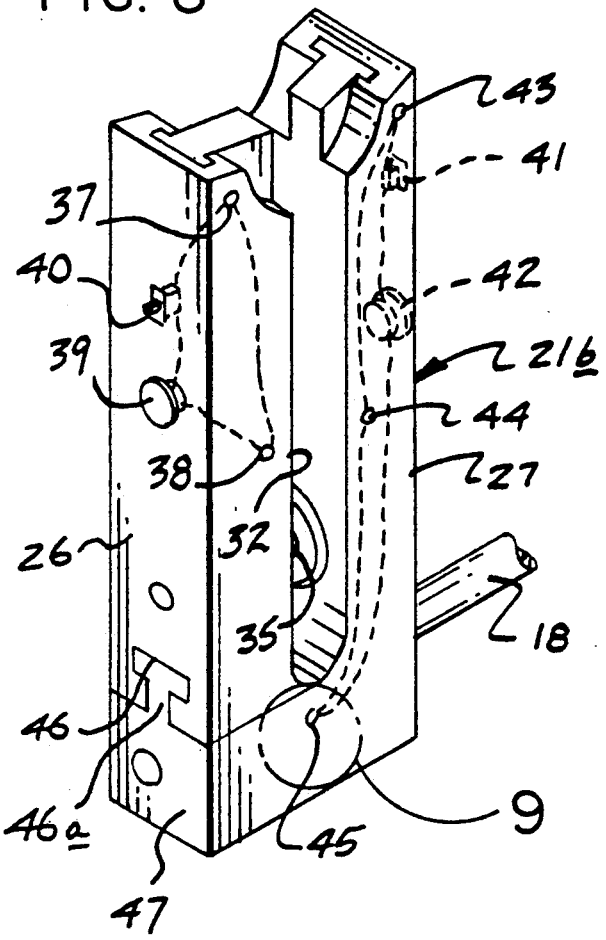
FIG. 8 is an isometric illustration of a further modified guide block structure.
Figure 9:
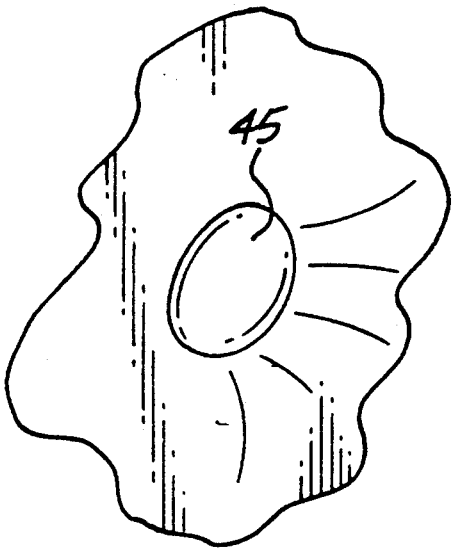
FIG. 9 is an enlarged isometric illustration of section 9 as set forth in FIG. 8.

The FIGS. 8 and 9 further includes a further modified guide block 21*b*, to include first and second indicator lights 37 and 38. The first indicator light 37 is positioned in adjacency to the first plate canted top wall, wherein the indicator light is positioned substantially medially adjacent the first plate interior wall 32. A first battery 39 mounted within the first plate is operative through a first switch to effect illumination of the first and second indicator lights 37 and 38. A second switch 41 operative through a second battery 42 mounted in the second plate effects selective actuation of respective third, fourth, and fifth indicator lights 43, 44, and 45. The third indicator light 43 is positioned in adjacency to the second plate canted top wall spaced an equal distance relative to the guide block base 47 as the first indicator light 47. Further, the fourth indicator light 44 is spaced medially and in adjacency to the second plate interior wall 34 at a further equal spacing as the second indicator light 38, with the fifth indicator light 45 positioned into the guide block base 47 below and medially of the first and second interior walls 32 and 34. In this manner, during evening and during periods of diminished available light, the first through fifth indicator lights may be employed for the positioning of an arrow on the guide block to properly orient the guide block and arrow for release relative to a target.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An archery bow arrow rest apparatus arranged for securement to an archery bow, wherein the apparatus comprises, a mounting plate arranged for securement to the archery bow, wherein the mounting plate includes a support head fixedly secured to the mounting plate, the support head including a support plate orthogonally oriented relative to the support head fixedly mounted to the support head, wherein the support plate includes a support plate opening, and the support head includes a support head boss extending below the support plate, wherein the support head boss includes a rotary shaft rotatably mounted to the support head boss, the rotary shaft having a first collar and a second collar, and the first collar and the second collar positioned on opposed sides of the support head boss fixedly secured to the rotary shaft, and a guide block mounted to the rotary shaft extending from the rotary shaft through the support plate opening to accommodate an arrow thereon, and the guide block includes a guide block base, and the guide block base having a guide block bottom wall, and a fastener directed through the guide block bottom wall, with the guide block having a guide block shaft receiving bore, with the rotary shaft directed into the shaft receiving bore, and the shaft fastener directed into engagement with the rotary shaft within the guide block shaft receiving bore, and a return spring, the return spring having a first end secured to the first collar, and the return spring having a second end secured to the support plate to maintain and bias the guide block in a substantial orthogonal relationship relative to the support plate, and the guide block includes a first plate and a second plate extending from the guide block base, wherein the first plate and the second plate include a gap therebetween, the first plate having a first plate canted top wall, the second plate having a second plate canted top wall defining an obtuse included angle relative to the first plate canted top wall and the second plate canted top wall, and the first plate includes a first bearing insert slidably received into the first plate, and the second plate having a second bearing insert directed into the second plate, wherein the first bearing insert and the second bearing insert are arranged in a facing relationship relative to one another, and wherein the first plate includes a first interior wall, the second plate includes a second plate interior wall, the first plate interior wall and the second plate interior wall arranged in a facing mirror image relationship relative to one another, with the first insert extending from the first plate canted top wall to the first plate interior wall, and the second bearing insert extending from the second plate canted top wall to the second plate interior wall, and the first plate includes a first plate T-shaped slot, and the guide block base includes a T-shaped projection, with the T-shaped projection slidably received within the T-shaped block, and a threaded adjuster rod oriented between the first plate and the second plate extending into the first plate and into the second plate, with the threaded adjuster rod having a rod first end rotatably and fixedly positioned relative to the first plate, with the threaded adjuster rod having an adjuster rod second end portion threadedly directed through the second plate, whereupon rotation of the threaded adjuster rod effects displacement of the first plate relative to the second plate along the T-shaped projection.

2. An apparatus as set forth in Claim 1 including a first indicator light positioned at the first plate canted top wall, and a second indicator light positioned in the first plate medially of the first plate adjacent the first plate interior wall, and a third indicator light mounted in the second plate adjacent the second plate canted top wall and the second plate interior wall, and a fourth indicator light positioned in the second plate adjacent the second plate interior wall, and the fifth indicator light mounted in the guide block base below the gap medially of the first plate interior wall and the second plate interior wall, and a first switch arranged for selective actuation of the first indicator light and the second indicator light, and a second switch arranged for selective actuation of the third indicator light, the fourth indicator light, and the fifth indicator light.

* * * * *